US006634070B2

(12) United States Patent
Willauer, Jr.

(10) Patent No.: US 6,634,070 B2
(45) Date of Patent: Oct. 21, 2003

(54) MULTI-COLORED MATERIALS AND METHOD OF MAKING SAME

(75) Inventor: Howard C. Willauer, Jr., Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/921,679

(22) Filed: Aug. 3, 2001

(65) Prior Publication Data

US 2003/0024093 A1 Feb. 6, 2003

(51) Int. Cl.[7] ..... D06P 7/00; D06B 11/00

(52) U.S. Cl. ..... 28/160; 28/159; 28/167; 28/169; 26/2 R

(58) Field of Search ..... 28/159, 160, 162, 28/163, 165, 167, 169, 214; 26/2 R, 27, 29 R, 30; 428/85, 88, 89, 92, 96; 156/72, 63, 148, 196, 199, 209, 296; 8/478, 479, 929, 494, 94.14, 114, 115, 147, 148, 149, 149.1, 149.2, DIG. 15, DIG. 16; 264/134, 245, 136, 243, 257, 258

(56) References Cited

U.S. PATENT DOCUMENTS

| | | | | | |
|---|---|---|---|---|---|
| 1,520,333 | A | * | 12/1924 | Creasey | 26/2 R |
| 1,871,249 | A | * | 8/1932 | Waite | 26/2 R |
| 2,563,259 | A | | 8/1951 | Miller | |
| 2,622,307 | A | * | 12/1952 | Cogovan et al. | 28/159 |
| 3,010,179 | A | | 11/1961 | Thal | |
| 3,012,303 | A | * | 12/1961 | Whitaker et al. | 28/159 |
| 3,464,779 | A | * | 9/1969 | Collez | 8/478 |
| 3,468,694 | A | * | 9/1969 | Moritz et al. | 8/929 |
| 3,688,338 | A | * | 9/1972 | Lundvall | 15/364 |
| 3,721,272 | A | * | 3/1973 | Hager | 28/160 |
| 3,917,883 | A | * | 11/1975 | Jepson | 26/2 R |
| 3,999,940 | A | * | 12/1976 | Freeman | 8/449 |
| 4,000,342 | A | * | 12/1976 | Rochelle et al. | 28/159 |
| 4,018,066 | A | * | 4/1977 | Fennekels et al. | 28/163 |
| 4,364,156 | A | | 12/1982 | Greenway et al. | |
| 4,393,562 | A | | 7/1983 | Stokes | |
| 4,418,451 | A | * | 12/1983 | Crenshaw | 26/2 R |
| 4,622,040 | A | | 11/1986 | Nicholas, Jr. | |
| 5,202,077 | A | | 4/1993 | Marco et al. | |
| 5,476,518 | A | | 12/1995 | Caleshu | |
| 5,688,599 | A | | 11/1997 | Bylund et al. | |
| 5,865,933 | A | | 2/1999 | Morin et al. | |
| 6,247,215 | B1 | | 6/2001 | Van Alboom et al. | |

* cited by examiner

*Primary Examiner*—Amy B. Vanatta
(74) *Attorney, Agent, or Firm*—Terry T. Moyer; Sara M. Current

(57) ABSTRACT

A material having a unique, multi-colored appearance is described. More specifically, a material having a multi-colored appearance and a three-dimensional surface is described, along with a method of making such a material. The process involves providing a pile material having an upper portion of the pile yarns of a first color and a lower portion of the pile yarns of a second color that is visually distinct from the first color, then treating the material so as to displace at least some of the pile yarns to a different position with respect to the base web portion of the fabric from other of the pile yarns. In this way, the lower portions of at least some of the pile yarns are exposed, to provide a unique visual appearance as a result of the color differential, and a unique three dimensional appearance as a result of the difference between the position of the treated and untreated portions.

34 Claims, 3 Drawing Sheets

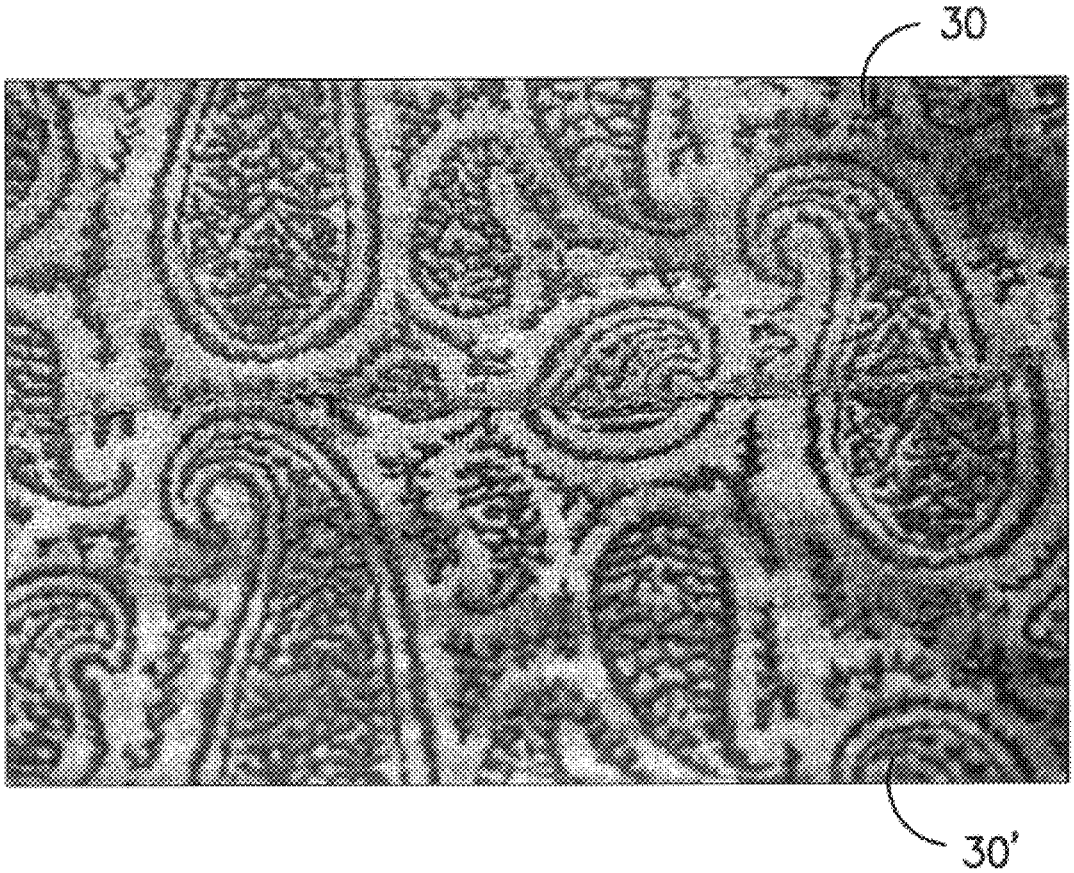
FIG. —5—

MULTI-COLORED MATERIALS AND METHOD OF MAKING SAME

BACKGROUND

Fabrics having unique, aesthetic characteristics are described. More specifically, fabrics having unique multi-colored appearances and unique, three-dimensional surface characteristics are described, along with a method of making such fabrics.

Fabric manufacturers are frequently called upon to provide fabrics having unique appearances and aesthetic characteristics, as designers are constantly seeking new tools to enable them to achieve varying designs in their fabrics and end products. Historically, designers have achieved unique looks for their fabrics through their choice of type and color(s) of yarns used, by dyeing the fabric, or by printing the fabric with a pattern of colors. An alternative method for achieved patterned fabrics is by modifying the mechanical structure of the fabric in particular areas. For example, the fabric can be sanded in particular areas, or treated with hydraulic or gaseous media to modify the position of the yarns in the fabric construction.

However, there continues to be a need for alternative methods for achieving unique and varied fabric appearances.

SUMMARY

With the foregoing in mind, the present invention enables the production of materials, and in particular textile materials, having unique multi-colored effects, in addition to unique three-dimensional structural appearances.

The process involves providing a pile fabric having a plurality of pile yarns extending from a base web portion at a first angle. At least some of the pile yarns have an lower portion (i.e. the portion proximate to the base web portion) that is a first color, and an upper portion (i.e. the portion remote from the base web portion) that is a second color, with the second color being visually distinct from the first color. (Where the invention is described as having at least first and second "colors", it is noted that the term is intended to encompass the situation where two distinct colors are used as well as where visual distinction is achieved through the use of two different shades of the same color.)

A variety of methods can be used within the scope of the invention to achieve the multi-color effects. For example, the fabric can be made from solution dyed or pre-dyed yarns, then the upper portion of at least some of the pile yarns can be dyed. However, in a preferred form of the invention, the fabric is dyed using a conventional type dye process (e.g., such as by jet dyeing the fabric), and the upper portions of at least some of the pile yarns achieve a second visually distinct color by a transfer printing process. In some aspects of the invention, it will be desirable to use a method for coloring the upper portion of at least some of the pile yarns which also serves to calender the yarns so that they define a relatively small angle relative to the base web portion. In other words, in some aspects of the invention, it has been found to be desirable for the first angle to be a relatively small angle, for reasons that will be discussed further herein.

The fabric is then treated in a manner designed to displace at least some of the pile yarns from their first position. This displacement can be in the angle direction, the lateral direction, or both the angle and lateral directions. The displacement can be performed randomly, or in a predetermined pattern. Because the upper portions of the pile yarns are visually distinct from the lower portions, in the locations where deflected pile yarns are adjacent to pile yarns in a different position (either laterally, angularly, or both), the color of the lower portion of the pile will be exposed. In this way, fabrics having unique color effects as well as three-dimensional effects are achieved. Furthermore, the visually distinct color of the lower portion of the pile yarns serves to outline the pattern, thereby enhancing the richness and textured effect of the design.

The method used to treat the material can be selected to achieve the desired visual characteristics for that particular substrate, but is desirably a hot air patterning treatment method. In a particularly preferred form of the invention, at least some of the pile yarns contain thermoplastic material, and the deflection treatment is performed at a temperature above the heat set temperature for the thermoplastic material. In this way, the fibers will retain the memory of their deflected position, such that the deflection pattern becomes "permanent" until the thermoplastic material is subjected to a temperature higher than that at which it was treated. Thus, the treatment can be performed at temperatures higher than those expected to be experienced during anticipated subsequent processes (e.g. anticipated washing and drying temperatures) so that the pile yarn deflection will be retained through those subsequent processing operations. For purposes of this application, this will be referred to as pattern durability, with a pattern being "durable" when it is capable of withstanding at least one home laundering according to AATCC Standardized Home Laundry Test Conditions, Designation III (1995) without significant pattern loss. This is in contrast to "nondurable" patterning methods such as conventional pile brushing methods, where the pile deflection would be lost if the material is washed or otherwise subjected to subsequent processes that would deflect the pile to a position different from its pattern position.

BRIEF DESCRIPTION OF THE DRAWINGS

FIG. 5 is a perspective view of another fabric of the invention, with the upper portion of the figure showing the fabric in its as-produced form, and the lower portion of the figure showing the same fabric after it had undergone twenty (20) home launderings according to AATCC Standard Home Laundry Test Condition, Designation III (1995).

DETAILED DESCRIPTION

Figure 1:
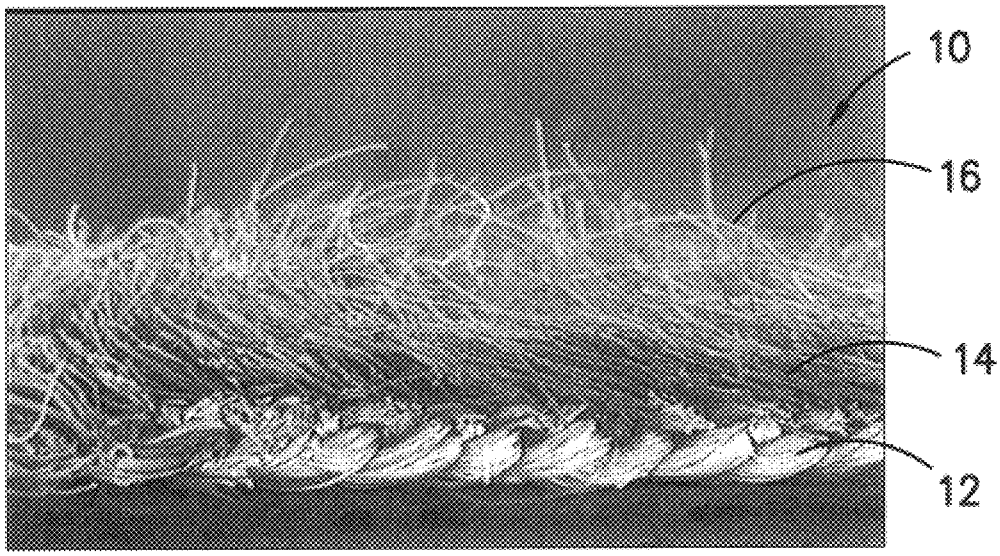
FIG. 1 is an enlarged (30×) cross-sectional view of a first fabric made according to the present invention.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The substrate comprises a base web portion and a pile portion extending outwardly from at least one face of the base web portion. The base web portion can be formed of any desired material, including but not limited to knit fabrics, woven fabrics, nonwoven fabrics, films, etc. The pile can also be formed in any desired manner, such as by integrally forming it with the base web portion (e.g. such as a knit pile fabric), tufting, napping, sanding or otherwise mechanically treating a fabric to form a pile, flocking, producing a sandwich construction fabric which is sliced to form two pile fabrics, or the like. Alternatively, the pile can be applied to the fabric such as by adhesive application or the like.

The base web portion can be formed of any type of fiber and/or material composition. For example, the base web portion can be formed from synthetic fibers or yarns, natural fibers or yarns, blends of fibers or yarns, polymer films or the like, or combinations thereof. Likewise, the pile portion can be formed from synthetic fibers or yarns, natural fibers or yarns, blends of fibers or yarns, or combinations thereof. As will be discussed more extensively below, the pile preferably includes some thermoplastic material, in order to enhance the durability of the three-dimensional pattern characteristics.

At least some of the pile yarns desirably are of a first color. In a preferred form of the invention, the first color is achieved by dyeing the fabric, such as by a conventional continuous, semi-continuous or discontinuous (i.e. batch) dye method. Alternatively, the first color of the pile yarns can be achieved by forming the pile from yarns having the desired first color. The base web portion can be of the same color as the pile yarns if desired, or can be of a different color (e.g. such as by forming it from fibers or yarns that do not respond to the dye in the same manner as the pile yarns, or by forming the base from a material that is a different color than the pile yarns.)

At least the upper portion of the pile (i.e., that portion of the pile that is farthest away from the base web portion) is then processed to render it a second color that is visually distinct from the first color. For example, the upper portion of the pile can have its color modified by transfer printing the fabric, spraying or misting a color on it, applying a dye with an engraved roll, screen printing, or the like. Preferably the color is applied uniformly across the surface of the fabric, although it can also be provided in a pattern within the scope of the instant invention. Particularly preferred are methods that modify the color of the upper portion of the pile without modifying the color of the lower portion of the pile. Also preferred are methods that serve to calender the pile toward the base web portion to make a slick "flattened or combed over" type of pile. In other words, in the preferred methods for coloring the pile yarns, the angle from which the pile yarns extend from the base web portion is altered as a result of the coloring or dyeing process.

For example, in a knit pile fabric, the pile would generally extend outwardly substantially perpendicular to the base web portion, so as to define a pile angle of about 90 degrees with respect to the base web portion. In the preferred methods for modifying the color of the upper portion of the pile, the original pile angle will be modified from its original pile position to assume a dyed pile position. For example, where the fabric is colored using a heat transfer print method, the pile yarns will generally assume and maintain a dyed pile position in which the pile yarns are at an angle of less than 90 degrees with respect to the base web portion because of the calendaring which inherently takes place as a result of the transfer print process.

As will be appreciated by those of ordinary skill in the art, when the pile is in any position other than completely perpendicular to the base web portion, it will be positioned or displaced in some direction relative to where its base is secured to the base web portion. (In other words, if one assumed the point where the pile yarn is secured to the base web portion is like the hand of a clock, then when the yarn is in any direction other than directly perpendicular to the base web portion, it will point toward a "number on the clock".) For purposes of this disclosure, this will be described as the lateral position of the pile yarn. Where a pile fabric has pile yarns initially at a 90 degree angle to the base, the pile yarns will therefore have a lateral position of substantially zero. However, once the pile yarns are angled at less than 90 degrees relative to the base, they will define an angle relative to the base as well as a lateral position. So in this way, two pile yarns may have the same angle relative to the base web portion, but have different lateral positions (e.g. one could be pointing towards twelve o'clock while the other is displaced toward nine o'clock.)

The pile is then treated in a manner designed to deflect a portion of the pile from its dyed pile position in certain regions to a treated pile position. The deflection can occur in the angle direction, the lateral direction, or both. In this way, the fabric will have a three-dimensional pattern defined by alternating regions of yarns in the dyed pile position and yarns in the treated pile position. Furthermore, because the lower portions of the pile yarns are of a first color and the upper portions of the pile yarns are of a second visually distinct color, in the regions of adjacency between treated and untreated pile portions, the visual color of the lower portion of the pile is exposed. This serves to enhance the definition and richness of the design. This process therefore enables an infinite number of designs to be produced simply by varying the quantity of pile yarns deflected at various angles and lateral positions, as well as the angle and lateral position to which they are deflected.

A preferred form of method for displacing portions of the pile is by contacting portions of the pile with a fluid, and in particular, a fluid that is provided at an elevated temperature. Preferably, the fluid is a hot gas such as air. However, other methods of pile displacement such as contacting the fabric with a pressurized liquid, other mechanical means of displacement such as contacting the fabric with a brush or the like, or combinations thereof can be used within the scope of the invention. Particularly preferred is the method of treating a fabric with heated air as described in commonly-assigned U.S. Pat. No. 4,393,562 to Stokes and U.S. Pat. No. 4,364,156 to Greenway et al., the disclosures of which are incorporated herein by reference.

As noted above, at least some of the pile yarns are preferably made from a thermoplastic material. When the method for displacing portions of the pile utilizes a heated mechanism or medium, the temperature can be selected so as to be above the heat set temperature of the particular thermoplastic material. In this way, the pile will retain the memory of the displaced position, so that the displacement is permanent (until the material sees a temperature higher than the treatment temperature). Furthermore, in this embodiment of the invention, the temperature can be selected to also be above the laundering temperatures expected for the fabric, so that the pile displacement will be permanent even through laundering of the fabric. For example, it has been found that by contacting a fabric having a polyester pile (which has a heat set temperature of 385 degrees F.) with air at a temperature of about 390 degrees F. or greater in the manner described in the '562 and '156 patents described above, a good permanent three-dimensional effect is provided to the fabric. In other words, the fibers retain their memory of the position where they have seen the highest temperature, and therefore they retain the position of their displacement. In a preferred form of the invention, the difference of angle between the dyed pile position and the treated pile position is at least 10 degrees, more preferably at least about 30 degrees, and more preferably at least about 50 degrees, even more preferably is least about 70 degrees, and even more preferably approaching 90 degrees. Similarly, the difference in lateral position of the dyed pile position and the treated position is at least about 30 degrees, more preferably at least about 70 degrees, and even more preferably about 90 degrees or greater or about 135 degrees or greater. In fact, it has been found that the difference in lateral position can approach 180 degrees, though typically the maximum will be expected to be about 160 degrees, due to the pile overlap. To this end, where fluid impingement is the mechanism of pile deflection, the fluid impingement of the fabric is desirably performed at an angle of about 1 to about 25 degrees. Typically, the fluid will be heated to a temperature of from about 280 to 800 degrees F.

As a further alternative, at least some of the pile yarns can include fibers designed to shrink upon contact with the treatment (e.g. they shrink in response to contact with hot air) so that the three dimensionality of the design can be further magnified.

Figure 3:
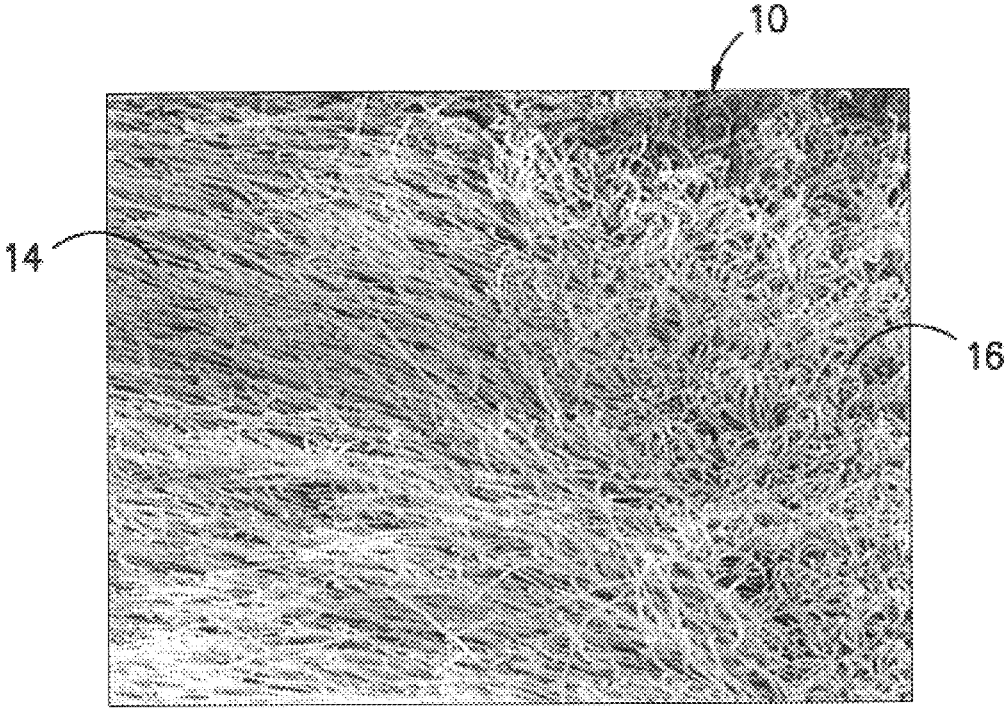
FIG. 3 is an enlarged plan view (25×) of the fabric shown in FIG. 1.

As noted, the fabrics made according to the instant invention have a combination of unique visual and three-dimensional effects. With reference to the drawings, FIG. 1 is a 30× enlarged photomicrograph of a cross-section of a first fabric made according to the invention, and FIG. 3 is a 25× photomicrograph of a plan view of the same fabric shown in FIG. 1. The fabric in FIG. 1, shown generally at 10, has a base web portion 12, and first and second pile regions 14 and 16, respectively. In this particular fabric view, the first pile portion 14 is closer to the viewer, while the second pile portion 16 is farther from the viewer, such that it is "behind" the first pile portion in this particular view. As is shown, the pile yarns 14, 16 extend outwardly from the base web portion 12. As can be seen, the pile yarns 14 are calendered towards the base web portion 12 as a result of having been heat transfer printed. Although difficult to discern in the photomicrographs, the upper portions of all of the pile yarns 14, 16 were colored a visually distinct color from that of lower portions of these same pile yarns and the base portion as a result of the heat transfer printing process. In this particular fabric, the pile was produced in a conventional manner using a warp knitting process. The pile yarns and the web portion were all formed from polyester yarns. The second pile region was treated with a hot air patterning treatment apparatus of the variety described previously at a temperature of about 410–420 degrees F. (i.e. other words, above the heat set temperature of the polyester yarns, which is about 385 degrees F.) The pile yarns of the second pile region were thereby deflected from their dyed pile position to a second position, which in this case was at a different angle from the base web portion than the yarns of the first pile region 14. In this way, a unique pattern was achieved. Furthermore, as can be seen more clearly in FIG. 3, delineation between the regions provides a unique three-dimensional effect.

Figure 2:
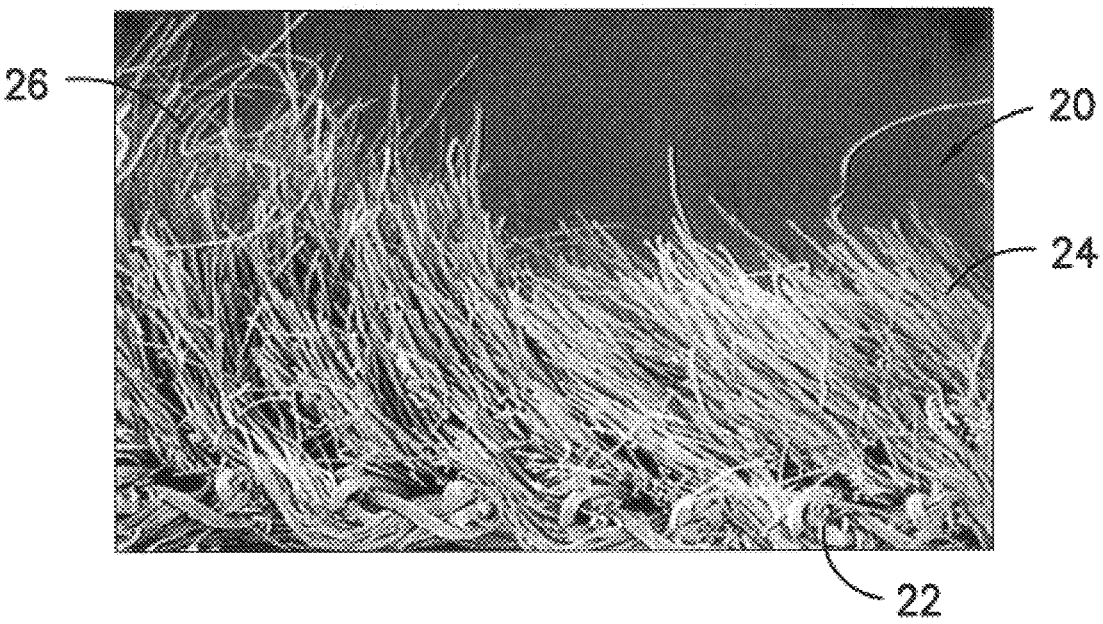
FIG. 2 an enlarged (30×) cross-sectional view of another fabric made according to the present invention.

FIG. 2 illustrates a cross-sectional view of a second fabric made according to the instant invention. As shown, the fabric, shown generally at 20, includes a base web portion 22, first pile region 24 and second pile region 26. This fabric was produced in the same manner described in FIG. 1, though the first and second colors used were different from those used in the FIG. 1 fabric. As can be readily seen, the pile regions were calendered so as to define a small angle relative to the base web portion. The second pile region 26 was treated to deflect the pile yarns, as illustrated by their larger angle relative to the base web portion.

Figure 4:
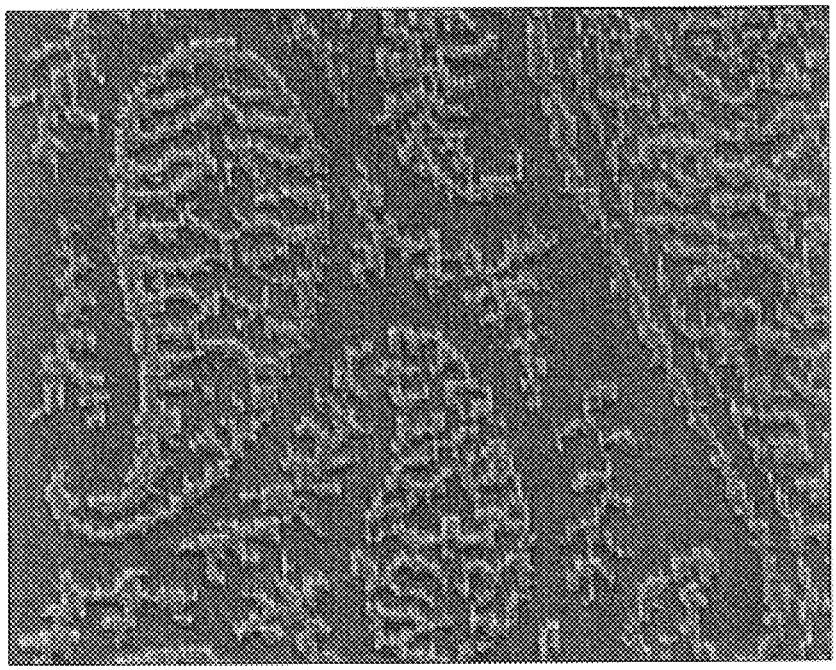
FIG. 4 is a reduced photograph of another fabric according to the invention, in its as-produced form.

FIG. 4 is a plan view of another fabric made according to the invention. In this fabric, the base web portion and pile yarns were jet dyed a light gray color, then the upper portions of the pile yarns were heat transfer printed a bright blue color. This heat transfer printing process also served to calender the yarns so that they had a small angle relative to the base web portion. The fabric was then treated in a pattern with a hot air pattern treatment (as described previously, that deflected some of the pile yarns to a different angle and/or lateral position from the dyed pile yarn position.) As illustrated, where the deflected yarns are adjacent to pile yarns deflected in a different direction, the light gray color of the lower pile yarn portions and/or base web portion are highly visible, and in other areas they are visible to a lesser extent. As a result, a unique pattern with significant depth and richness was achieved.

As noted above, the pile yarns can include thermoplastic fibers and the pile treatment can be performed at a temperature above the heat set temperature of the thermoplastic material to achieve a durable pattern. This is illustrated in FIG. 5. The fabric was produced in the same manner as that of FIG. 4, although in this case the base and lower portions of the pile were dyed a burgundy color, and the upper portions of the pile were heat transfer printed to render them a slightly darker shade of burgundy. The fabric shown at the top at 30 was in the as-produced form. The same fabric was then subjected to 20 home washes according to AATCC Standardized Home Laundry Test Conditions, Designation III (1995). The washed fabric is indicated at 30'. As illustrated, the pattern was still extremely pronounced ever after that large number of washings.

Fabrics made according to the invention can be produced to have virtually an infinite number of designs. In addition, they can be used in a wide variety of end uses, including but not limited to apparel, home furnishings such as upholstery fabric, bedspreads and drapery, automotive interiors, wall coverings, and the like.

In the specification there has been set forth a preferred embodiment of the invention, and although specific terms are employed, they are used in a generic and descriptive sense only and not for purpose of limitation, the scope of the invention being defined in the claims.

I claim:

1. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color, wherein said step of providing a pile material comprises a step of dyeing only the upper portion of at least some of said pile yarns; and treating the material to deflect at least a plurality of the pile yarns from their first position such that the lower portions of at least a plurality of said dyed pile yarns are exposed.

2. The method of claim 1, wherein said step of dyeing is performed by a process selected from the group consisting of transfer printing, spraying, misting, engraved roll dye application, and screen printing.

3. The method of claim 2, wherein said step of dyeing is performed by transfer printing.

4. The method of claim 1, wherein said step of treating is performed by a process selected from the group consisting of contacting the fabric with a pattern of hot gas, contacting the material with a pressurized liquid, and contacting the fabric with a brush.

5. The method of claim 1, wherein said step of treating the material to deflect at least a plurality of the pile yarns comprises a process selected from the group consisting of deflecting pile yarns to a different angle, deflecting yarns to a different lateral position, or combinations thereof.

6. The method of claim 5, wherein said step of treating the material to deflect at least a plurality of the pile yarns is performed such that at least some of the pile yarns are at a position at least 30 degrees different from said first pile position.

7. The method of claim 6, wherein the angle of pile yarns that were deflected is at least about 30 degrees different from the angle of the pile yarns in the first pile position.

8. The method of claim 6, wherein the angle of pile yarns that were deflected is at least about 50 degrees different from the angle of the pile yarns in the first pile position.

9. The method of claim 6, wherein the angle of pile yarns that were deflected is at least about 70 degrees different from the angle of the pile yarns in the first pile position.

10. The method of claim 6, wherein the angle of pile yarns that were deflected is at least about 90 degrees different from the angle of the pile yarns in the first pile position.

11. The method of claim 6, wherein the lateral position of pile yarns that were deflected is at least about 30 degrees different from the lateral position of the pile yarns in the first pile position.

12. The method of claim 6, wherein the lateral position of pile yarns teat were deflected is at least about 50 degrees different from the lateral position of the pile yarns in the first pile position.

13. The method of claim 6, wherein the lateral position of pile yarns that were deflected is at least about 70 degrees different from the lateral position of the pile yarns in the first pile position.

14. The method of claim 6, wherein the lateral position of pile yarns that were deflected is at least about 90 degrees different from the lateral position of the pile yarns in the first pile position.

15. The method of claim 6, wherein the lateral position of pile yarns that were deflected is at least about 135 degrees different from the lateral position of the pile yarns in the first pile position.

16. The method of claim 1, wherein said step of providing a pile material comprises providing a textile fabric.

17. The method of claim 1, wherein said step of treating is performed by contacting the material with a pattern of hot gas.

18. The method of claim 1, wherein said step of dyeing is performed by transfer printing and said step of treating is performed by contacting the fabric with a pattern of hot air.

19. The method of claim 1, wherein at least some of said pile yarns comprise a thermoplastic material, and said step of treating comprises treating the material at a temperature greater than a heat set temperature for the thermoplastic material, to thereby provide a durable pattern to the fabric.

20. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material to deflect at least a plurality of the pile yarns from their first position such that the lower portions of at least a plurality of said dyed pile yarns are exposed, wherein said step of treating is performed by contacting the material with a pattern of hot gas.

21. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material to deflect at least a plurality of the pile yarns from their first position such that the lower portions of at least a plurality of said dyed pile yarns are exposed, wherein said step of dyeing is performed by transfer printing and said step of treating is performed by contacting the fabric with a pattern of hot air.

22. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material to deflect at least a plurality of the pile yarns from their first position such that the lower portions of at least a plurality of said dyed pile yarns are exposed, wherein at least some of said pile yarns comprise a thermoplastic material, and said step of treating comprises treating the material at a temperature greater than a heat set temperature for the thermoplastic material, to thereby provide a durable pattern to the fabric.

23. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color, wherein said step of providing a pile material comprises a step of dyeing only the upper portion of at least some of said pile yarns; and treating the material such that the lower portions of at least a plurality of said dyed pile yarns are exposed.

24. The method of claim 23, wherein said step of dyeing is performed by a process selected from the group consisting of transfer printing, spraying, misting, engraved roll dye application, and screen printing.

25. The method of claim 24, wherein said step of dyeing is performed by transfer printing.

26. The method of claim 23, wherein said step of treating is performed by a process selected from the group consisting of contacting the fabric with a pattern of hot gas, contacting the material with a pressurized liquid, and contacting the fabric with a brush.

27. The method of claim 23, wherein said step of treating the material comprises deflecting at least a plurality of the pile yarns by a process selected from the group consisting of deflecting pile yarns to a different angle, deflecting yarns to a different lateral position, or combinations thereof.

28. The method of claim 23, wherein said step of providing a pile material comprises providing a textile fabric.

29. The method of claim 26, wherein said step of treating is performed by contacting the material with a pattern of hot gas.

30. The method of claim 23, wherein said step of dyeing is performed by transfer printing and said step of treating is performed by contacting the fabric with a pattern of hot air.

31. The method of claim 23, wherein at least some of said pile yarns comprise a thermoplastic material, and said step of treating comprises treating the material at a temperature greater than a heat set temperature for the thermoplastic material, to thereby provide a durable pattern to the fabric.

32. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material such that the lower portions of at least a plurality of said dyed pile yarns are exposed, wherein said step of treating is performed by contacting the material with a pattern of hot gas.

33. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material such that the lower portions of at least a plurality of said dyed pile yarns are exposed, wherein said step of dyeing is performed by transfer printing and said step of treating is performed by contacting the fabric with a pattern of hot air.

34. A method of making a material having a unique visual appearance comprising the steps of:

providing a pile material comprising a base web portion and a plurality of pile yarns extending outwardly from the base web portion at a first position relative to the base web portion, wherein at least a plurality of the pile yarns are dyed pile yarns having a lower portion proximate to the base web portion that is a first color and an upper portion remote from the base web portion that is a second color, with the second color being visually distinct from the first color; and treating the material such that the lower portions of at least a plurality of said dyed pile yarns are exposed, wherein at least some of said pile yarns comprise a thermoplastic material, and said step of treating comprises treating the material at a temperature greater than a heat set temperature for the thermoplastic material, to thereby provide a durable pattern to the fabric.

* * * * *